United States Patent [19]

Van Steenwyk

[11] Patent Number: 4,468,863

[45] Date of Patent: Sep. 4, 1984

[54] HIGH SPEED WELL SURVEYING

[75] Inventor: Donald H. Van Steenwyk, San Marino, Calif.

[73] Assignee: Applied Technologies Associates, San Marino, Calif.

[21] Appl. No.: 293,159

[22] Filed: Aug. 17, 1981

[51] Int. Cl.[3] ..... G01C 9/00

[52] U.S. Cl. ..... 33/304; 33/312

[58] Field of Search ..... 33/302, 304, 313, 312, 33/324; 175/45, 40, 50

[56] References Cited

U.S. PATENT DOCUMENTS

| | | | |
|---|---|---|---|
| 2,309,905 | 2/1943 | Irwin et al. . | |
| 2,635,349 | 4/1953 | Green . | |
| 2,674,049 | 4/1954 | James . | |
| 2,681,567 | 6/1954 | Widess . | |
| 2,806,295 | 9/1957 | Ball . | |
| 3,037,295 | 6/1962 | Roberson . | |
| 3,052,029 | 9/1962 | Wallshein . | |
| 3,137,077 | 6/1964 | Rosenthal . | |
| 3,241,363 | 3/1966 | Alderson et al. . | |
| 3,308,670 | 3/1967 | Granqvist . | |
| 3,561,129 | 2/1971 | Johnston . | |
| 3,753,296 | 8/1973 | Van Steenwyk . | |
| 3,894,341 | 7/1975 | Kapeller . | |
| 4,197,654 | 4/1980 | Van Steenwyk et al. | 33/304 |
| 4,199,869 | 4/1980 | Van Steenwyk | 33/302 |
| 4,238,889 | 12/1980 | Barriae | 33/304 |
| 4,265,028 | 5/1981 | Van Steenwyk | 33/304 |

FOREIGN PATENT DOCUMENTS

| | | |
|---|---|---|
| 1306781 | 2/1973 | United Kingdom . |
| 1437125 | 5/1976 | United Kingdom . |
| 2009419 | 6/1979 | United Kingdom . |
| 2027904 | 2/1980 | United Kingdom . |
| 2039371 | 8/1980 | United Kingdom . |
| 2094484 | 9/1982 | United Kingdom . |

*Primary Examiner*—William D. Martin, Jr.

*Attorney, Agent, or Firm*—William W. Haefliger

[57] ABSTRACT

A borehole survey method employs a first sensor for measuring angular rate, and a second sensor or sensors for sensing tilt, and a rotary drive for the first and second sensors, and includes the steps:

(a) operating the drive and the first and second sensors at a first location in the borehole to determine the azimuthal direction of tilt of the borehole at such location, (b) then traveling the first and second sensors and the drive lengthwise of the borehole away from the location, and operating the drive and at least one of the first and second sensors during such traveling to determine changes in borehole alignment during such traveling.

5 Claims, 12 Drawing Figures

GYRO G2 OUTPUT
139a
GYRO G1 OUTPUT
139b
145 A
ACCEL A1 OUTPUT
N
W
S
E 12
10
20
13
11
M
14
15
16
ANGULAR RATE SENSOR
16a
14a
16b
423
424
200
201
425
152
163
150
160
182
COMP. CIRCUIT
(or ω₁'' or ω₁''')
162
153
183
184
180
181
427a
427
428a
428
431
432
430
433
158
167
151
161
LINEAR ACCEL. SENSOR
17
17a
17b
CONV. CIRCUIT
COMP. CIRCUIT
430a
430b
434
436a
436
437a
437
14b
18
ACCEL. SENSOR
23
14c
187
MASTER CONTROL
TO SWITCHES

435
COMPUTER (TILT) ~191~
θ TILT
426
COMPUTER (AZIMUTH) ~190~
ψ AZIMUTH

HIGH SPEED WELL SURVEYING

BACKGROUND OF THE INVENTION

This invention relates generally to surveying of boreholes, and more particularly concerns methods and apparatus which enable significant reductions in well survey time.

In the past, the task of position mapping a well or borehole for azimuth in addition to tilt has been excessively complicated, very expensive, and often inaccurate because of the difficulty in accommodating the size and special requirements of the available instrumentation. For example, magnetic compass devices typically require that the drill tubing be fitted with a few tubular sections of non-magnetic material, either initially or when drill bits are changed. The magnetic compass device is inserted within this non-magnetic section and the entire drill stem run into the hole as measurements are made. These non-magnetic sections are much more expensive than standard steel drill stem, and their availability at the drill site must be pre-planned. The devices are very inaccurate where drilling goes through magnetic materials, and are unusable where casing has been installed.

Directional or free gyroscopes are deployed much as the magnetic compass devices and function by attempting to remember a pre-set direction in space as they are run in the hole. Their ability to initially align is limited and difficult, and their capability to remember degrades with time and environmental exposure. Also, their accuracy is reduced as instrument size is reduced, as for example becomes necessary for small well bores. Further, the range of tilt and azimuthal variations over which they can be used is restricted by gimbal freedom which must be limited to prevent gimbal lock and consequent gyro tumbling.

A major advance toward overcoming these problems is described in my U.S. Pat. No. 3,753,296. That invention provides a method and means for overcoming the above complications, problems, and limitations by employing that kind and principal of a gyroscope known as a rate-of-turn gyroscope, or commonly 'a rate gyro', to remotely determine a plane containing the earth's spin axis (azimuth) while inserted in a bore hole or well. The rate gyroscope has a rotor defining a spin axis; and means to support the gyroscope for travel in a bore hole and to rotate about an axis extending in the direction of the hole, the gyroscope characterized as producing an output which varies as a function of azimuth orientation of the gyroscope relative to the earth's spin axis. Such means typically includes a carrier containing the gyroscope and motor, the carrier being sized for travel in the well, as for example within the drill tubing. Also, circuitry is operatively connected with the motor and carrier to produce an output signal indicating azimuthal orientation of the rotating gyroscope relative to the carrier, whereby that signal and the gyroscope output may be processed to determine azimuth orientation of the carrier and any other instrument thereon relative to the earth's spin axis, such instrument for example comprising a well logging device such as a radiometer, inclinometer, etc.

U.S. Pat. No. 4,192,077 improves upon 3,753,296 in that it provides for use of a "rate gyro" in combination with a free gyroscope, with the rate gyro used to periodically calibrate the free gyroscope. While this combination has certain benefits, it does not provide the unusually advantageous modes of operation and results as are afforded by the present invention. Among these are the enablement of very rapid surveying of boreholes; the lack of need for a free gyroscope to be periodically calibrated; and reduction in time required for surveying slanted boreholes, of particular advantage at depths where high temperatures are encountered.

SUMMARY OF THE INVENTION

It is a major object of the invention to provide method and apparatus facilitating rapid surveying of boreholes, as referred to. Typically, the survey method employs first means for measuring angular rate, and second means for sensing tilt, and a rotary drive for the first and second means, the basic steps of the method including:

(a) operating the drive and the first and second means at a first location in the borehole to determine the azimuthal direction of tilt of the borehole at such location, (b) then traveling the first and second means and the drive lengthwise of the borehole away from that location, and operating the drive and at least one of the first and second means during such traveling to determine changes in borehole alignment during traveling.

As will be seen, the (b) step of the method typically involve maintaining an input axis defined by the second means at a predetermined orientation (such as horizontal) during traveling, the drive being controlled to accomplish this. For example, the second means may include first and second accelerometers, the latter accelerometer having its input axis maintained horizontal during such travel. Accordingly, if the borehole changes its direction of tilt during instrumentation travel, the first accelerometer detects the amount of change; in addition, first means (such as a rate of turn sensor or gyroscope) senses changes in azimuth during the travel between upper and lower positions in the well. Further, the (a) step of the method may be carried out at each of the upper and lower positions prior to and subsequent to such travel, for accurately determining azimuthal direction of tilt of the hole at such locations. These (a) and (b) steps may be carried out in alternation, up or down the hole, to enable rapid surveying, as will be seen.

Additional method steps include adjusting the angularity (cant angle) of the axis of sensitivity of the first accelerometer relative to the longitudinal direction of travel in the borehole, to improve the determination of azimuthal direction of tilt of the hole; and the use of output from one or more of the sensors (angular rate sensor and acceleration sensor or sensors) to compensate the output or outputs from others of such sensors.

Apparatus embodying the invention comprises:

(a) first sensor means for measuring angular rate about one or more axes, (b) second sensor means for sensing tilt or acceleration along one or more axes, (c) rotary drive means for rotating and controling said first and second means in the borehole, and (d) circuit means operatively connected between said second means and rotary drive means for:

(i) allowing the drive to rotate the first and second means at a first location in the borehole to determine the azimuthal direction of tilt of the borehole at said location, and (ii) causing the drive to maintain an axis defined by said second means at a predetermined orientation relative to horizontal during traveling of the apparatus in the borehole, whereby at least one of the first and second means may be operated during such traveling to determine changes in borehole alignment along the borehole length.

As will appear, the first sensor means may comprise a rate-of-turn gyroscope; and the second sensor means may comprise first and second tilt sensors, such as accelerometers, the second tilt sensor defining the axis which is maintained at predetermined orientation during travel in the borehole. Also, a resolver may be associated with the first and second sensor means. In addition, means may be provided to adjust the cant or angularity of the first tilt sensor; and other circuitry may be provided to compensate signals derived from the output of either sensor in accordance with values of signals derived from the output of the other of the sensors, or vice versa, to produce compensated signals, thereby improving accuracy.

These and other objects and advantages of the invention, as well as the details of illustrative embodiments, will be more fully understood from the following description and drawings, in which:

DRAWING DESCRIPTION

FIG. 1 is an elevation taken in section to show one form of instrumentation employing the invention;

FIG. 1*a* is a circuit diagram;

Figure 2:
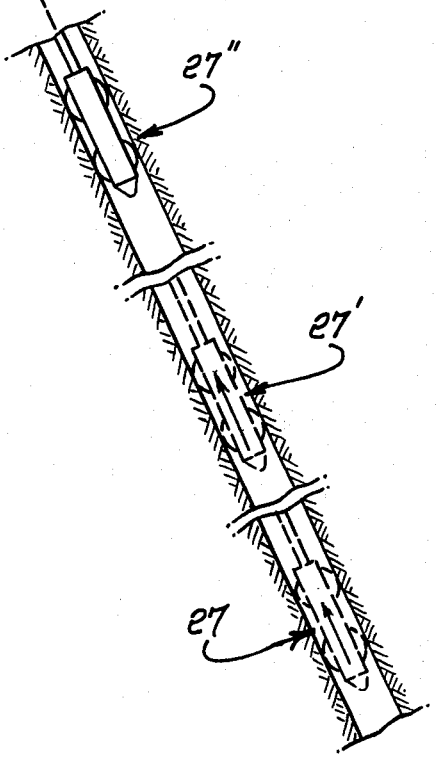
FIG. 2 is an elevation showing use of the FIG. 1 instrumentation in multiple modes, in a borehole.
Figure 10A:
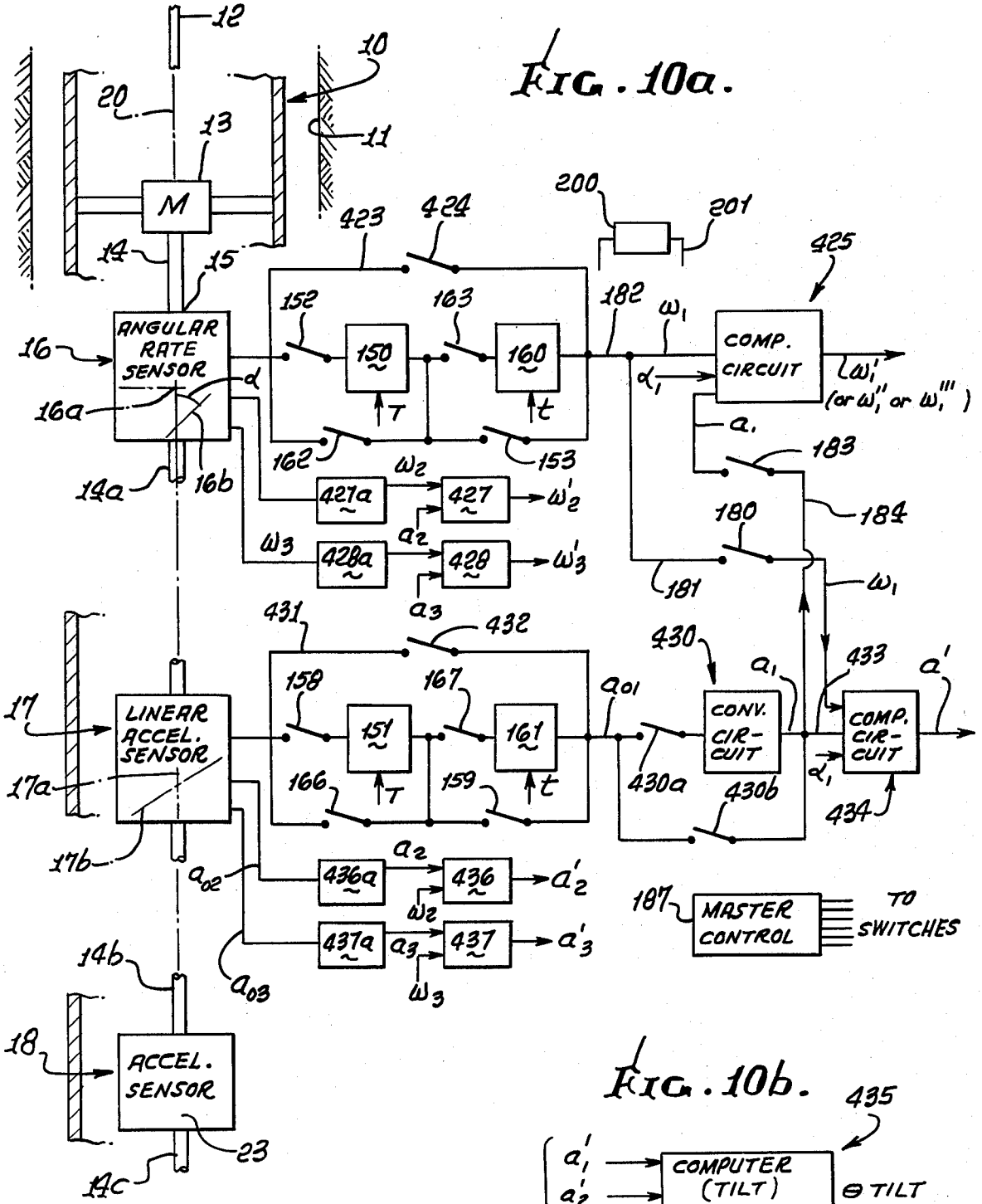
Figure 10B:
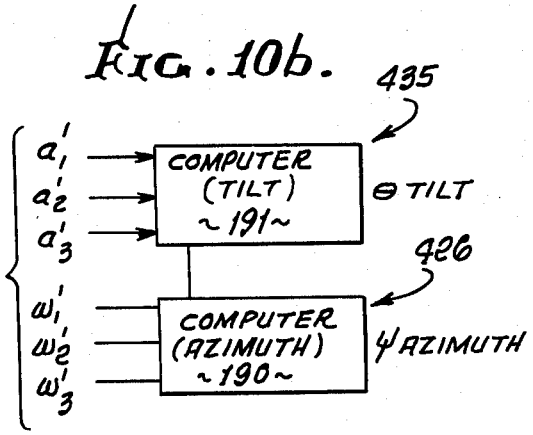

FIGS. 10*a* and 10*b* show a further modified form of apparatus usable in the dual modes shown in FIG. 2.

DETAILED DESCRIPTION

Figure 1:
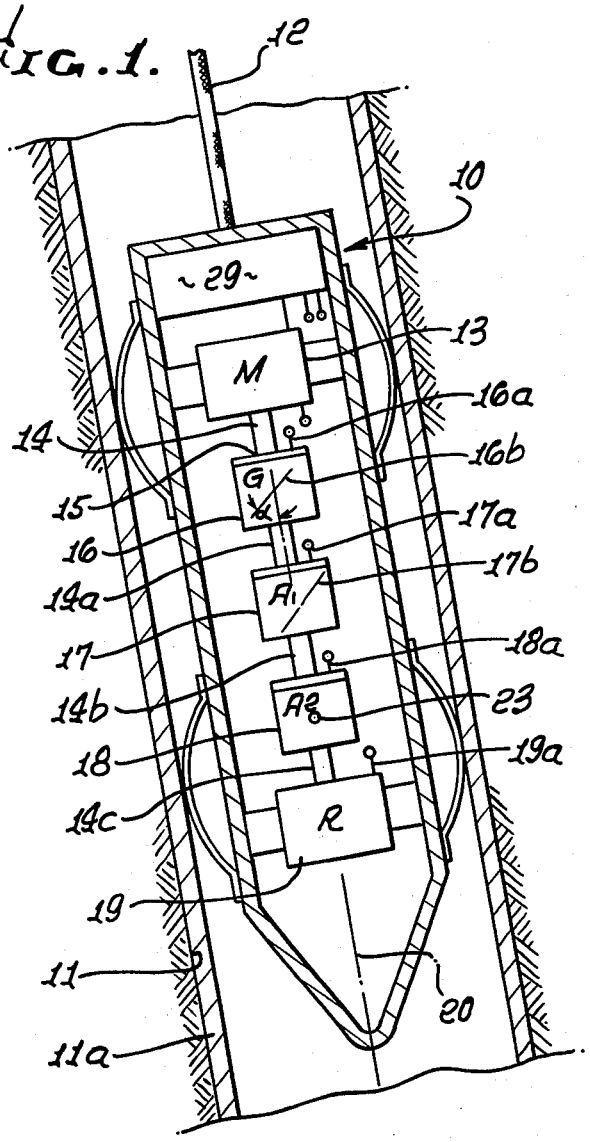
Figure 1:
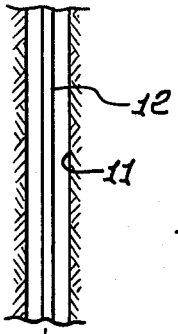

Referring to FIG. 1, a carrier such as elongated housing 10 is movable in a borehole indicated at 11, the hole being cased at 11*a*. Means such as a cable to travel the carrier lengthwise in the hole is indicated at 12. A motor or other manipulatory drive means 13 is carried by and within the carrier, and its rotary output shaft 14 is shown as connected at 15 to an angular rate sensor means 16. The shaft may be extended at 14*a*, 14*b* and 14*c* for connection to first acceleration sensor means 17, second acceleration sensor means 18, and a resolver 19. The accelerometers 17 and 18 can together be considered as means for sensing tilt. These devices have terminals 16*a*–19*a* connected via suitable slip rings with circuitry indicated at 29 carried within the carrier (or at the well surface, if desired).

Figure 1A:
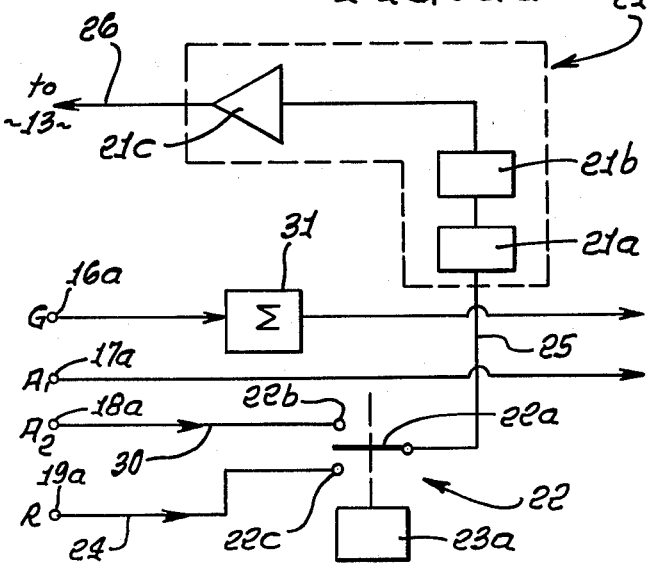

Circuitry 29 typically may include a feed back arrangement as shown in FIG. 1*a*, and incorporating a feed back amplifier 21, a switch 22 having arm 22*a* and contacts 22*b* and 22*c*, and switch actuator 23*a*. When the actuator closes arm 22*a* with contact 22*c*, the resolver 19 is connected in feed back relation with the drive motor 13 via leads 24, 25, and 26, and amplifier 21, and the apparatus operates for example as described in U.S. Pat. No. 3,753,296 to determine the azimuthal direction of tilt of the bore hole at a first location in the bore hole. See for example first location indicated at 27 in FIG. 2. Other U.S. Pat. Nos. describing such operation are 4,199,869, 4,192,077 & 4,197,654. During such operation, the motor 13 rotates the sensor 16 and the accelerometers either continuously, or incrementally.

The angular rate sensor 16 may for example take the form of one or more of the following known devices, but is not limited to them:

1. Single degree of freedom rate gyroscope
2. Tuned rotor rate gyroscope
3. Two axis rate gyroscope
4. Nuclear spin rate gyroscope
5. Sonic rate gyroscope
6. Vibrating rate gyroscope
7. Jet stream rate gyroscope
8. Rotating angular accelerometer
9. Integrating angular accelerometer
10. Differential position gyroscopes and platforms
11. Laser gyroscope
12. Combination rate gyroscope and linear accelerometer Each such device may be characterized as having a "sensitive" axis, which is the axis about which rotation occurs to produce an output which is a measure of rate-of-turn, or angular rate $\omega$. That value may have components $\omega_1$, $\omega_2$ and $\omega_3$ in a three axis co-ordinate system. The sensitive axis may be generally normal to the axis 20 of instrument travel in the bore hole, or it may be canted at some angle $\alpha$ relative to axis 20 (see canted sensitive axis 16*b* in FIG. 1).

Figure 3:
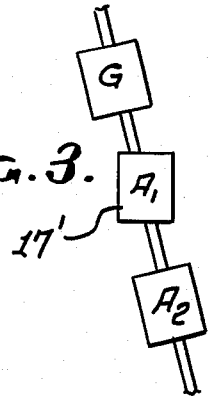
FIG. 3 is a schematic elevation showing a modification of the FIG. 1 instrumentation.

The acceleration sensor means 17 may for example take the form of one or more of the following known devices; however, the term "acceleration sensor means" is not limited to such devices:

1. one or more single axis accelerometers
2. one or more dual axis accelerometers
3. one or more triple axis accelerometers Examples of acceleration sensors include the accelerometers disclosed in U.S. Pat. Nos. 3,753,296 and 4,199,869, having the functions disclosed therein. Such sensors may be supported to be orthogonal or canted at some angle $\alpha$ relative to the carrier axis. They may be stationary or carouseled, or may be otherwise manipulated, to enhance accuracy and/or gain an added axis or axes of sensitivity. In this regard the sensor 17 typically has two imput axes of sensitivity. A canted axis of sensitivity is seen at 17*b* in FIG. 1, and a canted accelerometer 17' (corresponding to accelerometer 17 in FIG. 1) is seen in FIG. 3. The axis of sensitivity is the axis along which acceleration measurement occurs.

The second accelerometer 18 may be like accelerometer 17, excepting that its input axis 23 is typically orthogonal to the input axes of the sensor 16 and of the accelerometer 17. During travel mode, i.e. lifting or lowering of the carrier 10 in the borehole 11, indicated at 27' in FIG. 2, the output of the second accelerometer 18 is connected via lead 30 (in FIG. 1*a*), contact 22*b*, switch arm 22*a*, and servo amplifier 21 to the drive motor 13. The servo system causes the motor to rotate the shaft 14 until the input axis 23 of accelerometer is horizontal (assuming that the borehole has tilt as in FIG. 2). Typically, there are two such axis 23 horizontal positions, but logic circuitry in the servo-system may for example cause rotation until the output of acceleration sensor 18 is positive. Amplifier 21 typically includes signal conditioning circuits 21*a*, feedback compensation circuits 21*b*, and power amplifier 21*c* driving the motor M shown at 13.

If, for example, the borehole is tilted 45° due East at the equator, accelerometer 17 would register +0.707 g or 45°, and the angular rate sensor 16 would register no input resulting from the earth's rate of rotation. If, then, the apparatus is raised (or lowered) in the borehole, while input axis 23 of accelerometer 18 is maintained horizontal, the output from accelerometer 17 would remain constant, assuming the tilt of the borehole remains the same. If, however, the hole tilt changes direction (or its elevation axis changes direction) the accelerometer 17 senses such change, the amount of such change being recorded at circuitry 29, or at the surface. If the hole changes its azimuth direction during such instrument travel, the sensor 16 senses the change, and the sensor output can be integrated as shown by integrator circuit 31 in FIG. 1*a* (which may be incorporated in circuitry 29, or at the surface) to register the angle of azimuth change. The instrumentation can be traveled at high speed along the tilted borehole while recording such changes in tilt and azimuth, to a second position (see position 27" in FIG. 2). At that position, the instrumentation is again operated as at 27 (mode #1) to accurately determine borehole tilt and azimuth—essentially a re-calibration step. Thus, the apparatus can be traveled hundreds or thousands of feet, operating in mode #2 as described, and between calibration positions at which travel is arrested and the device is operated in mode #1.

The above modes of operation are typically useful in the tilted portion of a borehole; however, normally the main i.e. lower portion of the oil or gas well is tilted to some extent, and requires surveying. Further, this part of the hole is typically at relatively high temperature where it is desirable that the instrumentation be moved quickly to reduce exposure to heat, the invention lending itself to these objectives. In the vertical or near vertical (usually upper) portion of the hole, the instrumentation can revert to mode #1 operation, at selected positions, as for example at 100 or 200 foot intervals. In a near vertical hole, azimuth contributes very little to hole position computation, so that mode #1 positions can be spaced relatively far apart, and thus this portion of the hole can be mapped rapidly, as well.

Figure 4:
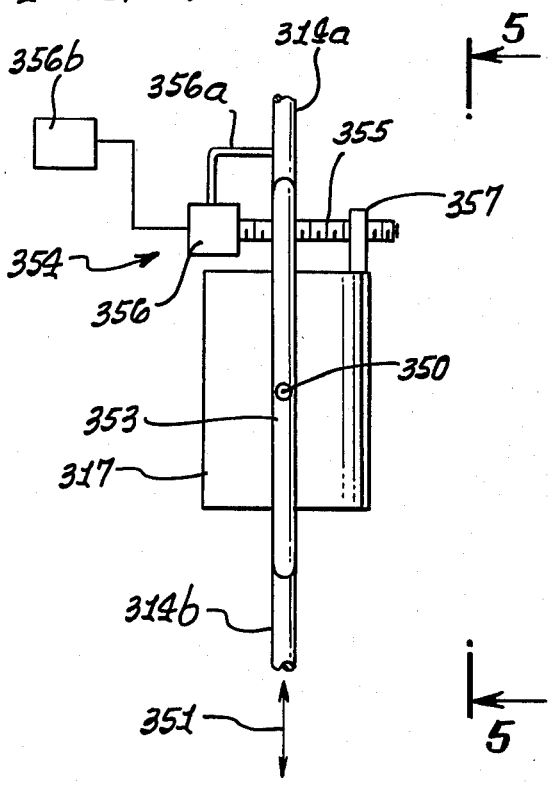
FIG. 4 is a fragmentary elevation showing variable cant mechanism as usable in the FIG. 1 instrumentation.
Figure 5:
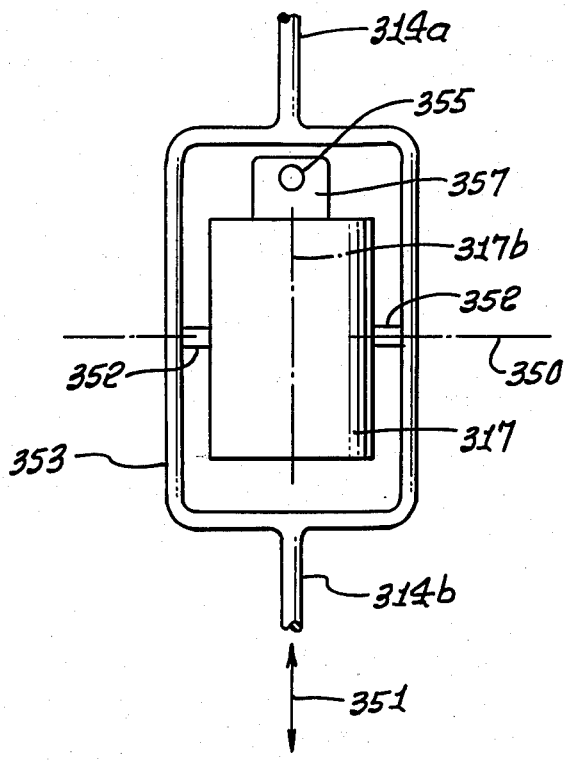
FIG. 5 is a side view taken on lines 5—5 of FIG. 4.

FIGS. 4 and 5 illustrate technique for adjusting the angularity of the axis of sensitivity of the first accelerometer relative to the lengthwise direction of instrument travel in the borehole. As shown, the accelerometer 317 (corresponding to accelerometer 17) has an axis of sensitivity (input axis) shown at 317*b*, which is rotatable about an axis 350 which is substantially normal to the direction of travel 351 in the borehole. Shaft extensions 314*a* and 314i b correspond to extensions 14*a* and 14*b* in FIG. 1. The accelerometer 317 is carried by pivots 352 in a frame 353 to which shaft extensions 314*a*and 314*b* are connected, as shown. Control means 354 is also carried by the frame to adjust the cant of axis 317*b*, as for example at locations of mode #1 operation as described above, to improve the determination of azimuthal direction of tilt of the borehole, at such "calibration" locations, and/or at other instrument locations in the hole. The control means 354 may, for example, comprise a jack screw 355 driven by a reversible motor 356 suspended at 356*a* by the frame. The jack screw extends laterally and interfits a nut 357 attached to the accelerometer case, as for example at its top, offset from axis 350. A servo system 356*b* for the drive may be employed, so that a chosen angularity of axis 317*b* relative to direction 351 may be achieved. Support or suspension 356*a* may be resiliently yieldable to allow the accelerometer to be adjustably tilted, without jamming of the drive or screw.

Figures 6, 7, 8:
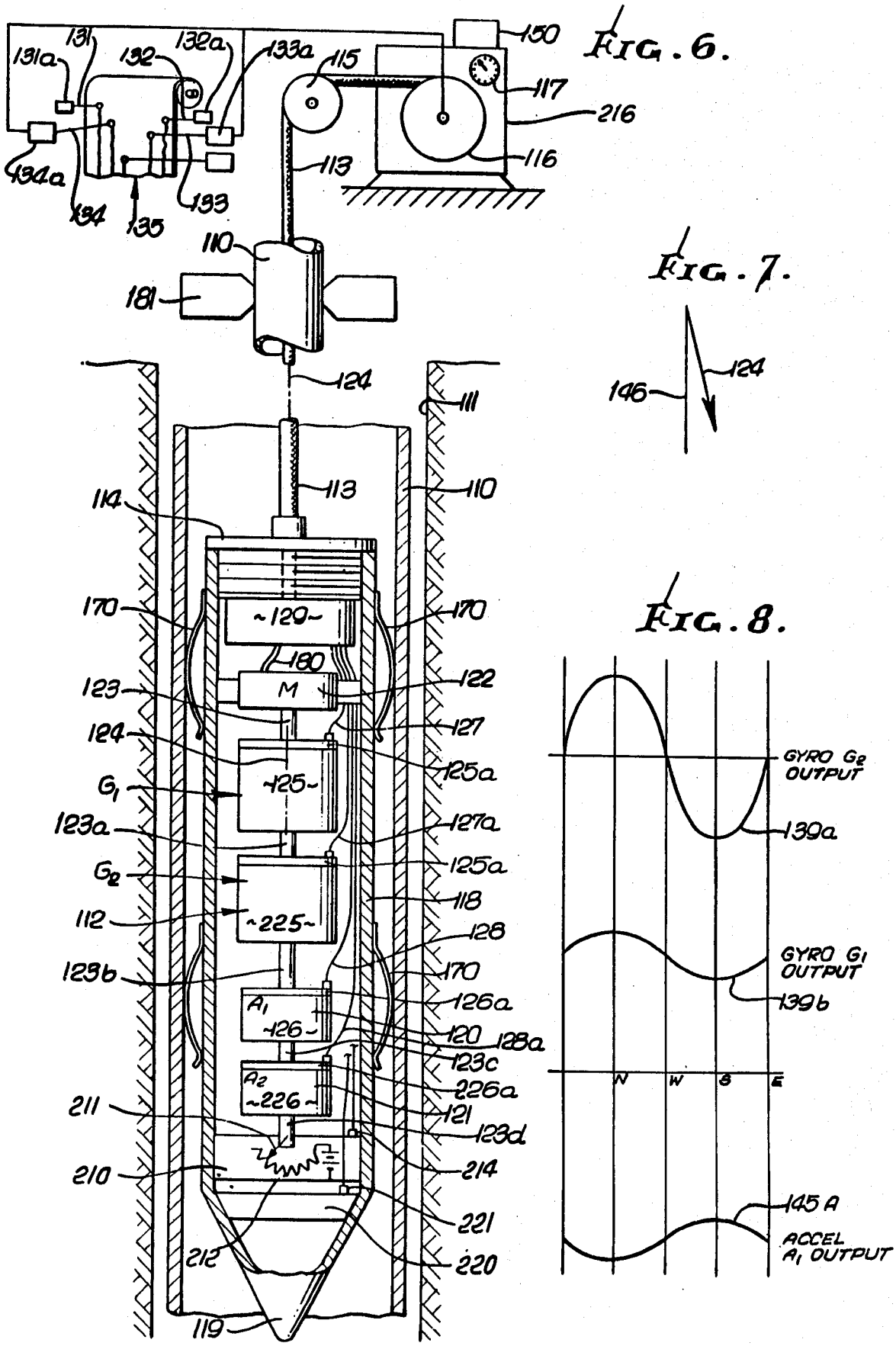
FIG. 6 is a vertical section showing further details of the FIG. 1 apparatus as used in a borehole.
FIG. 7 is a diagram indicating tilt of the apparatus in a slanted borehole.
FIG. 8 is a wave form diagram.

FIGS. 6–8 show in more detail the apparatus of FIG. 1, and associated surface apparatus. In FIG. 6, well tubing 110 extends downwardly in a well 111, which may or may not be cased. Extending within the tubing is a well mapping instrument or apparatus 112 for determining the direction of tilt, from vertical, of the well or borehole. Such apparatus may readily be traveled up and down in the well, as by lifting and lowering of a cable 113 attached to the top 114 of the instrument. The upper end of the cable is turned at 115 and spooled at 116, where a suitable meter 117 may record the length of cable extending downwardly in the well, for logging purposes.

The apparatus 112 is shown to include a generally vertically elongated tubular housing or carrier 118 of diameter less than that of the tubing bore, so that well fluid in the tubing may readily pass, relatively, the instrument as it is lowered in the tubing. Also, the lower terminal of the housing may be tapered at 119, for assisting downward travel or penetration of the instrument through well liquid in the tubing. The carrier 118 supports first and second angular sensors such as rate gyroscopes $G_1$ and $G_2$, and accelerometers 120 and 121, and drive means 122 to rotate the latter, for travel lengthwise in the well. Bowed springs 170 on the carrier center it in the tubing 110.

The drive means 122 may include an electric motor and speed reducer functioning to rotate a shaft 123 relatively slowly about a common axis 124 which is generally parallel to the length axis of the tubular carrier, i.e. axis 124 is vertical when the instrument is vertical, and axis 124 is tilted at the same angle form vertical as is the instrument when the latter bears sidewardly against the bore of the tubing 110 when such tubing assumes the same tilt angle due to borehole tilt from vertical. Merely as illustrative, for the continuous rotation case, the rate of rotation of shaft 124 may be within the range 0.5 RPM to 5 RPM. The motor and housing may be considered as within the scope of means to support and rotate the gyroscope and accelerometers.

Due to rotation of the shaft 123, and lower extensions 123*a*, 123*b* and 123*c* thereof, the frames 125 and 225 of the gyroscopes and the frames 126 and 226 of the accelerometers are typically all rotated simultaneously about axis 124, within and relative to the sealed housing 118. The signal outputs of the gyroscopes and accelerometers are transmitted via terminals at suitable slip ring structures 125*a*, 225*a*, 126*a* and 226*a*, and via cables 127 127*a*, 128 and 128*a*, to the processing circuitry at 129 within the instrument, such circuitry for example including that described above, and multiplexing means if desired. The multiplexed or non-multiplexed output from such circuitry is transmitted via a lead in cable 113 to a surface recorder, as for example include pens 131–134 of a strip chart recorder 135, whose advancement may be synchronized with the lowering of the instrument in the well. The drivers 131*a*–134*a* for recorder pens 131–134 are calibrated to indicate borehole azimuth, degree of tilt and depth, respectively, and another strip chart indicating borehole depth along its length may be employed, if desired. The recorder can be located at the instrument for subsequent retrieval and read-out after the instrument is pulled from the hole.

The angular rate sensor 16 may take the form of gyroscope $G_1$ or $G_2$, or their combination, as described in U.S. Pat. No. 4,199,869. Accelerometers 126 and 226 correspond to 17 and 18 in FIG. 1.

Figure 9:
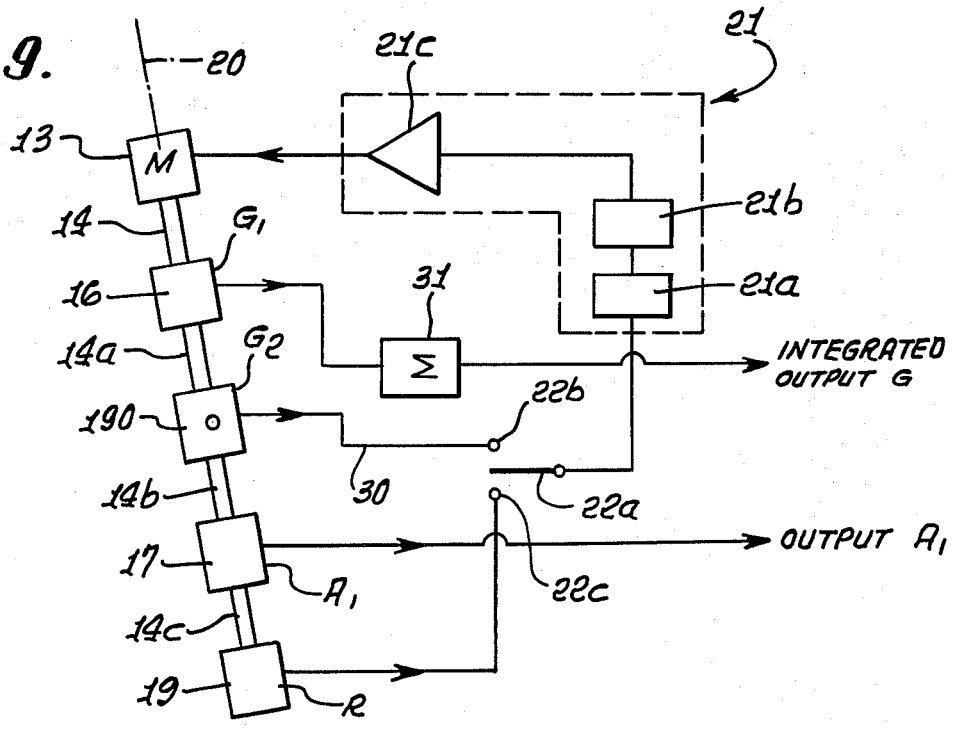
FIG. 9 is a block diagram showing modified apparatus.

In FIG. 9 the elements 13, 16, 17 and 19 are the same as in FIG. 1; however, the second accelerometer 18 of FIG. 1 is replaced by a gyroscope 190 which serves the same function as the second accelerometer 18, i.e. the gyroscope 190 maintains a gimble axis fixed (as for example horizontal) during instrumentation travel in mode #2, and its output is connected via the servo loop **22*b*, 22*a*, and amplifier 21 to the drive motor 13, so that if the hole changes direction in tilt, during such travel, accelerometer 17 will sense the amount of change, for recordation. The gyroscope 190** may be the second axis of a two-axis gyroscope, the other input axis of which is the first gyroscope.

Referring now to angular rate sensor 16 shown in FIG. **10*a* it may produce one output $\omega_1$, i.e. one component of angular rate, or it may produce two or three components, as for example the components of $\omega$ along three axes. See in this regard U.S. patent application Ser. No. 241,708. Considering one component $\omega_1$, it may be directly passed via path 423 and switch 424 to input to the compensation circuit means 425. The latter processes $\omega_1$ and produces a corresponding output $\omega_1'$. In FIG. 10*b* computer 426 receives intputs $\omega_1'$,$\omega_2'$, and $\omega_3'$ to produce azimuth output $\psi$. Inputs $\omega_2'$ and $\omega_3'$ are derived from compensation circuits indicated at 427 and 428**, and which correspond to circuitry 425'.

In similar manner, the acceleration sensor 17 produces an output $a_{01}$ which, after conversion at 430 becomes output $a_1$. Output $a_{01}$ is transmitted via path 431, which includes switch 432, to co-ordinate conversion circuit 430. If no conversion is required, circuit 430 is eliminated or by-passed (by opening switch **430*a* and closing switch 430*b*), and $a_{01}$ becomes the same as $a_1$. The sensor 17 may also produce component outputs $a_{02}$ and $a_{03}$, which after conversion become $a_2$ and $a_3$ respectively. The sum of the component vectors corresponding to $a_{01}$, $a_{02}$ and $a_{03}$ equals the acceleration vector, and the sum of the component vectors $a_1$, $a_2$ and $a_3$ also equals the acceleration vector. The reason for converting to $a_1$, $a_2$ and $a_3$ is to produce components in the same co-ordinate system as $\omega_1$, $\omega_2$ and $\omega_3$, i.e. the $\omega$ system. Circuitry 430 is well known, as indicated in U.S. patent application Ser. No. 241,708. A similar co-ordinate conversion may be performed upon $\omega_1$, as by means 200 connectible in series in path 201, to convert $\omega_1$ (and also $\omega_2$ and $\omega_3$ ) coordinates the same as the coordinates of $a_1$, $a_2$, and $a_3$; and devices 430 and 200** may be used to convert into another or third coordinate system.

In FIG. **10*a*, output $a_1$ is directly passed via path 133 to input to the compensation circuit means 134. The latter processes $a_1$, and produces a corresponding output $a_1'$. Computer 435 in FIG. 10*b* receives inputs $a_1'$, $a_2'$ and $a_3'$ to produce tilt output $\theta$. Inputs $a_2'$ and $a_3'$ are derived from compensation circuits indicated at 436 and 437, and which correspond to circuitry 434**.

Further, an acceleration sensor 18 may also be connected to shaft 14 via shaft extension **14*b*, to be rotated with the sensors 16 and 17, and it typically has its sensitive axis 23 (along which acceleration is measured) normal to the shaft 14** (generally parallel to the borehole).

In accordance with an important aspect of the invention, any of the compensation circuits 425, 427, 428, 434,436 and 437 may be regarded as a compensation means operatively connected with the sensor means (as for example sensors 16 and 17) for compensating signals derived from the output of at least one of the sensor means (one of 16 and 17, for example) in accordance with values of signals derived from other of the sensor means (the other of 16 and 17 for example), to produce compensated signals. Thus, for example the circuit means is connected with the sensor means to adjust angular rate signals derived from the output of the angular rate sensor thereby to compensate for acceleration effects associated with acceleration signals derived from the output of the acceleration sensor means, so as to produce corrected angular rate values. The compensation means may be indicated at 425 to adjust angular rate signals $\omega_1$ derived from the output of the angular rate sensor 16, thereby to compensate for acceleration effects associated with acceleration signals (as at $a_1$) derived from the output of the acceleration sensor means, to produce corrected angular rate values, $\omega_1'$. This correction removes the influence of gravity from the angular rate value, for example. Also, corrected values $\omega_1''$ and $\omega_1'''$ may be produced, as described in said U.S. patent application Ser. No. 241,708.

Also associated with the apparatus of FIG. **10*a* is temperature compensating circuit means to compensate signals derived from at least one, or both, of the sensors 16 and 17 in accordance with temperature changes encountered in the borehole. See for example the circuitry 150 associated with sensor 16, and circuitry 151 asscoiated with sensor 17. When switches 152 and 153 are closed, and switch 424 open, the output of sensor 16 passes through circuitry 150 and to compensating circuitry 425 previously disccused. Thus, if the output of sensor 16 is undesirably increased by an amount $\omega\Delta_T$ due to borehole high temperature, the circuitry 150** eliminates $\omega\Delta_T$ from that output. Known circuitry to produce such compensation is described in said U.S. application Ser. No. 241,708.

In addition, time compensating circuit means is shown in association with the sensors 16 and 17 to compensate their outputs in accordance with selected time values. See for example the time compensating circuit 160 associated with sensor 16, and circuitry 161 associated with sensor 17. When switches 162 and 163 are closed, and switches 152, 124 and 153 are open, the output of sensor 16 passes through circuitry 160, and to compensation circuitry 425 discussed above. Thus, for example, if the voltage output of sensor 16 degrades or diminishes in amplitude over a period of time, it may be restored by circuit 160. An example of a known time compensating (gain restorative) circuit is described in said application Ser. No. 241,708. There are other examples of time compensation, including phase shift, etc.

If desired, switches 152 and 163 may be closed and switches 424, 162 and 163 opened, to pass the output of 16 through both compensators 150 and 160 for both temperature and time compensation.

Similar time compensation switches are shown at 436 and 437 in association with sensor 17.

The above discussed compensation means 134 is shown as operatively and selectively connected with the sensors 16 and 17 to adjust acceleration signals $a_1$ derived from the output of the acceleration sensor 17 to compensate for angular rate effects associated with angular rate signals $\omega_1$ derived from the output of the angular rate sensor 16, thereby to produce corrected accelerationvalues $a_1'$. The compensator 434 may be similar to compensator 425.

Each of blocks 427*a* and 428*a* respectively in series with compensation circuits 427 and 428 represents temperature and time circuits like 150 and 160 and associated switches. Likewise, each of blocks 436*a* and 437*a* respectively in series with compensation circuits 436 and 437 represents circuits like 151, 161, 430 and associated switches. Blocks 427 and 436 have cross over connections corresponding to connections 181 and 184, and blocks 428 and 437 also have such cross-over connections.

Note also in FIG. 10*a* the switch 180 in the cross-over path 181 extending from the $\omega_1$ input path 182 to compensator 425, to provide $\omega_1$ input to compensator 434; and the switch 183 in the cross-over path 184 extending from the $a_1$ input path 433 to compensator 434, to provide $a_1$ input to compensator 425.

Some or all of the switches shown in FIG. 10*a* may be suitably and selectively controlled from a master control 187, either in the borehole or at the borehole surface. Thus, for example, either or both of the compensators 425 and 434 may be employed to compensate as described, by control of switches 180 and 183; and various ones or combinations of the temperature and time compensators may be employed, or excluded, by selective operation of the switches associated therewith, as described and shown.

The described circuitry connected to the outputs of the sensors 16 and 17 may be located in the borehole (as on the carrier) outside the borehole (as at the well surface) or partly in the hole and partly out.

FIG. 10b shows circuit means, such as a computer 190, connected with one or both of the compensation circuits 425, 427 and 428, to receive corrected angular rate values $\omega_1'$, $\omega_2'$ and $\omega_3'$ and to produce an output which varies as a function of azimuth orientation of the sensor 16. Operation of the computer is as generally described in Ser. No. 241,708. Also, FIG. 10*b* shows circuit means, such as a computer 191, connected with one or more of the compensation circuits 434, 436 and 437 to receive corrected acceleration values $a_1'$, $a_2$; and $a_3'$, and produce an output which varies as a function of tilt of the acceleration sensor means. Operation of the computer 191 is as generally described in Ser. No. 241,708, filed Mar. 9, 1981.

The compensation principles as discussed above may be applied not only to a system which includes one angular rate sensor, but also to two or more angular rate sensors, each or either of which may be connected in compensating relation with an accelerometer or tilt detector. Thus, one or more accelerometers may be employed.

I claim:

1. In a borehole survey method which employs first means for measuring angular rate, and second means for sensing tilt, said second means having at least two input axes of sensitivity, said first and second means having outputs, and a rotary drive for said first and second means, the steps that include (a) operating the drive and the first and second means at a first location in the borehole, and while travel of said means lengthwise in the borehole is arrested, to determine the azimuthal direction of tilt of the borehole at such location, (b) then traveling the first and second means and the drive lengthwise of the borehole away from the first location, and operating the drive and at least one of the first and second means during such traveling to determine changes in borehole alignment which occur during traveling, (c) said (b) step including operating the drive to adjust and maintain one of said input axes horizontal during said traveling, (d) said (b) step also including integrating the output of said first means to determine changes in borehole azimuth during said traveling.

2. The method of claim 1 wherein said second means is operated in feed back relation with said drive during said (b) step.

3. The method of claim 1 which employs a resolver having a rotary element rotated by said drive, the step that includes operating said resolver during said (a) step and in feed back relation with said drive.

4. In a borehole survey method which employs first means for measuring angular rate, and second means for sensing tilt, said second means having two input axes of sensitivity, said first and second means having outputs, and a rotary drive for said first and second means, the steps that include (a) operating the drive and the first and second means at a first location in the borehole, and while travel of said means lengthwise in the borehole is arrested, to determine the azimuthal direction of tilt of the borehole at such location, (b) then traveling the first and second means and the drive lengthwise of the borehole away from the first location, and operating the drive and at least one of the first and second means during such traveling to determine changes in borehole alignment which occur during traveling, (c) said (b) step carried out to determine and maintain a horizontal direction during said travel through use of at least one of said two input axes, (d) said (b) step also including integrating the output of said first means to determine changes in borehole azimuth during said traveling.

5. The method of claim 1 wherein said (a) and (b) steps are repeated at different locations in the bore hole.

* * * * *